US005711728A

United States Patent [19]

Marcelo

[11] Patent Number: 5,711,728

[45] Date of Patent: Jan. 27, 1998

[54] SHOCK AND VIBRATION ABSORBING BALL BAT

[76] Inventor: Severino V. Marcelo, 3488 Baskerville Rd., Fremont, Calif. 94555

[21] Appl. No.: 738,399

[22] Filed: Oct. 25, 1996

[51] Int. Cl.[6] ..... A63B 59/06

[52] U.S. Cl. ..... 473/520; 473/564

[58] Field of Search ..... 473/564–568, 473/451, 520

[56] References Cited

U.S. PATENT DOCUMENTS 537,927 4/1895 Kennedy ..... 473/564

2,031,161 2/1936 Hamel ..... 473/568

*Primary Examiner*—Mark S. Graham

[57] ABSTRACT

A new Shock and Vibration Absorbing Ball Bat for absorbing the shock and vibration forces generated when the bat strikes a ball before the forces reach the hands of the batter. The inventive device includes a hitting portion, a handle portion, an intermediate portion between the hitting portion and the handle portion, and a series of knurls provided along the intermediate portion of the bat above the handle portion and below the hitting portion. The knurls are coaxially aligned with the intermediate portion of the bat and define a peripheral wall which has a diameter greater than that of the intermediate portion of the bat immediately adjacent the knurl whereby the knurl is radially enlarged relative to the intermediate portion of the bat immediately adjacent the knurl. In a first embodiment, each of the knurls is a convex knurl wherein the peripheral wall of the convex knurl is convex-shaped. In a second embodiment, each of the knurls is a cylindrical knurl wherein the peripheral wall of the cylindrical knurl is cylindrical-shaped.

6 Claims, 3 Drawing Sheets

SHOCK AND VIBRATION ABSORBING BALL BAT

BACKGROUND OF THE INVENTION

1. Field of the Invention

The present invention relates to baseball bats and more particularly pertains to a new Shock and Vibration Absorbing Ball Bat for absorbing the shock and vibration forces generated when the bat strikes a ball before the forces reach the hands of the batter.

2. Description of the Prior Art

The use of baseball bats is known in the prior art. More specifically, baseball bats heretofore devised and utilized are known to consist basically of familiar, expected and obvious structural configurations, notwithstanding the myriad of designs encompassed by the crowded prior art which have been developed for the fulfillment of countless objectives and requirements.

Known prior art baseball bats include U.S. Pat. No. 5,219,164; U.S. Pat. No. 5,165,686; U.S. Pat. No. 344,777; U.S. Pat. No. 4,572,508; U.S. Pat. No. 4,331,330 and U.S. Pat. No. 4,653,754.

While these devices fulfill their respective, particular objectives and requirements, the aforementioned patents do not disclose a new Shock and Vibration Absorbing Ball Bat. The inventive device includes a hitting portion, a handle portion, an intermediate portion between the hitting portion and the handle portion, and a series of knurls provided along the intermediate portion of the bat above the handle portion of the bat.

In these respects, the Shock and Vibration Absorbing Ball Bat according to the present invention substantially departs from the conventional concepts and designs of the prior art, and in so doing provides an apparatus primarily developed for the purpose of absorbing the shock and vibration forces generated when the bat strikes a ball before the forces reach the hands of the batter.

SUMMARY OF THE INVENTION

In view of the foregoing disadvantages inherent in the known types of baseball bats now present in the prior art, the present invention provides a new Shock and Vibration Absorbing Ball Bat construction wherein the same can be utilized for absorbing the shock and vibration forces generated when the bat strikes a ball before the forces reach the hands of the batter.

The general purpose of the present invention, which will be described subsequently in greater detail, is to provide a new Shock and Vibration Absorbing Ball Bat apparatus and method which has many of the advantages of the baseball bats mentioned heretofore and many novel features that result in a new Shock and Vibration Absorbing Ball Bat which is not anticipated, rendered obvious, suggested, or even implied by any of the prior art baseball bats, either alone or in any combination thereof.

To attain this, the present invention generally comprises a hitting portion, a handle portion, an intermediate portion between the hitting portion and the handle portion, and a series of knurls provided along the intermediate portion of the bat above the handle portion of the bat.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Shock and Vibration Absorbing Ball Bat apparatus and method which has many of the advantages of the baseball bats mentioned heretofore and many novel features that result in a new Shock and Vibration Absorbing Ball Bat which is not anticipated, rendered obvious, suggested, or even implied by any of the prior art baseball bats, either alone or in any combination thereof.

It is another object of the present invention to provide a new Shock and Vibration Absorbing Ball Bat which may be easily and efficiently manufactured and marketed.

It is a further object of the present invention to provide a new Shock and Vibration Absorbing Ball Bat which is of a durable and reliable construction.

An even further object of the present invention is to provide a new Shock and Vibration Absorbing Ball Bat which is susceptible of a low cost of manufacture with regard to both materials and labor, and which accordingly is then susceptible of low prices of sale to the consuming public, thereby making such Shock and Vibration Absorbing Ball Bat economically available to the buying public.

Still yet another object of the present invention is to provide a new Shock and Vibration Absorbing Ball Bat which provides in the apparatuses and methods of the prior art some of the advantages thereof, while simultaneously overcoming some of the disadvantages normally associated therewith.

Still another object of the present invention is to provide a new Shock and Vibration Absorbing Ball Bat for absorbing the shock and vibration forces generated when the bat strikes a ball before the forces reach the hands of the batter.

Yet another object of the present invention is to provide a new Shock and Vibration Absorbing Ball Bat which includes a hitting portion, a handle portion, an intermediate portion between the hitting portion and the handle portion, and a series of knurls provided along the intermediate portion of the bat above the handle portion of the bat.

Still yet another object of the present invention is to provide a new Shock and Vibration Absorbing Ball Bat that improves a batter's performance by providing comfort for the hands of the batter.

Even still another object of the present invention is to provide a new Shock and Vibration Absorbing Ball Bat that improves a batter's performance by enabling the batter to hit a ball harder and further without having to swing harder.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
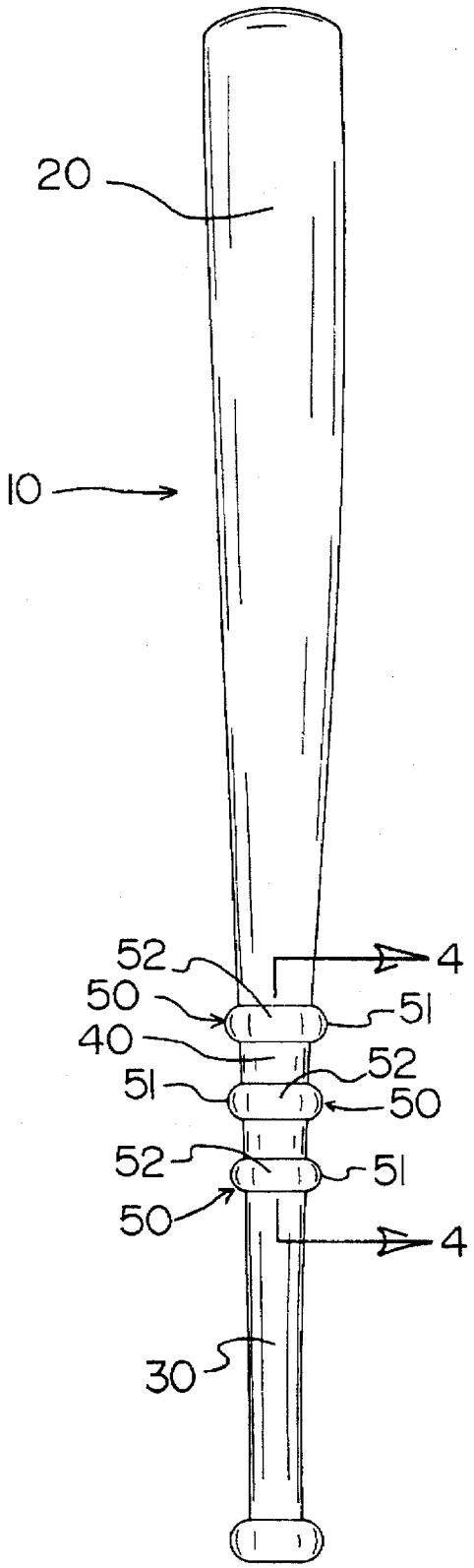
FIG. 1 is an illustration of a first embodiment of a new Shock and Vibration Absorbing Ball Bat according to the present invention.

With reference now to the drawings, and in particular to FIGS. 1 through 5 thereof, a new Shock and Vibration Absorbing Ball Bat embodying the principles and concepts of the present invention and generally designated by the reference numeral 10 will be described.

More specifically, it will be noted that the Shock and Vibration Absorbing Ball Bat 10 comprises a hitting portion 20, a handle portion 30, an intermediate portion 40 between the hitting portion 20 and the handle portion 30, and a knurl 50 provided along the intermediate portion 40 of the bat 10 above the handle portion 30 and knob or below the hitting portion 20. The knurl 50 is coaxially aligned with the intermediate portion 40 of the bat 10 and has a peripheral wall 51 which has a diameter greater than the diameter of the intermediate portion 40 of the bat 10 immediately adjacent the knurl 50 whereby the knurl 50 is radially enlarged relative to the intermediate portion 40 of the bat 10 immediately adjacent the knurl 50. To increase the shock and vibration absorbing characteristics of the bat 10, a plurality of knurls 50 may be provided in a spaced relation along the intermediate portion 40 of the bat 10.

Figure 4:
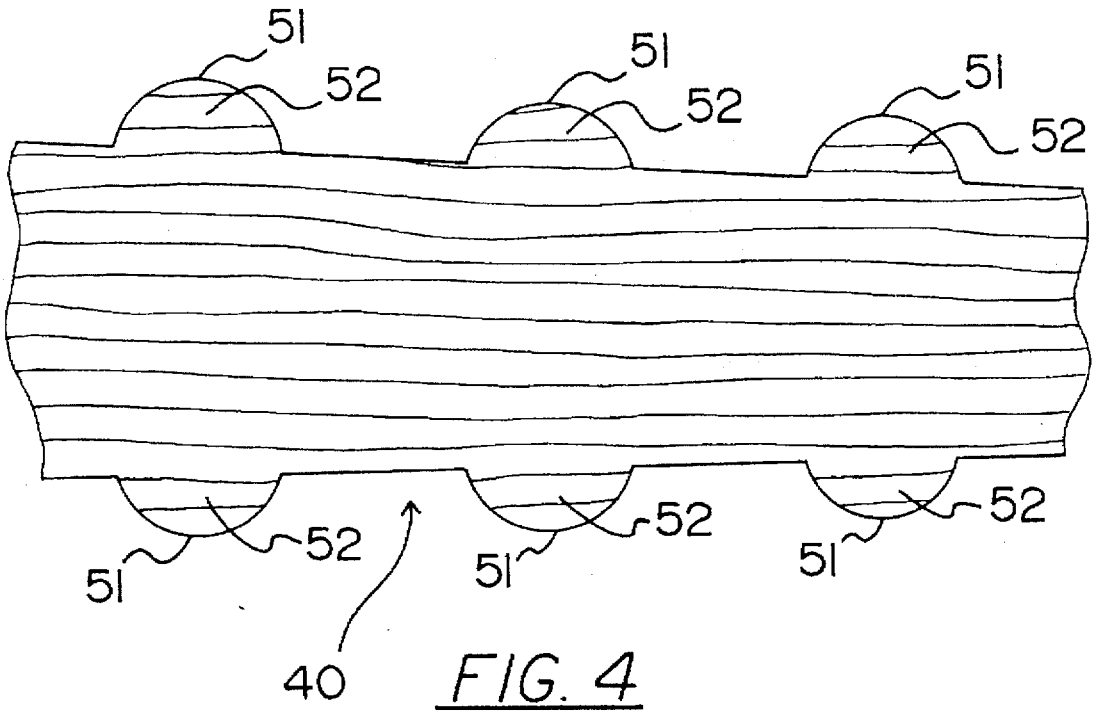
FIG. 4 is a cross sectional view taken along line 4—4 of FIG. 1.

As best illustrated in FIGS. 1 and 4, it can be shown that in a first embodiment of the present invention the knurl 50 is a convex knurl 52 wherein the peripheral wall 51 of the convex knurl 52 is convex-shaped. In the first embodiment, three convex knurls 50 are provided in spaced relation along the intermediate portion 40 of the bat 10.

Figure 2:
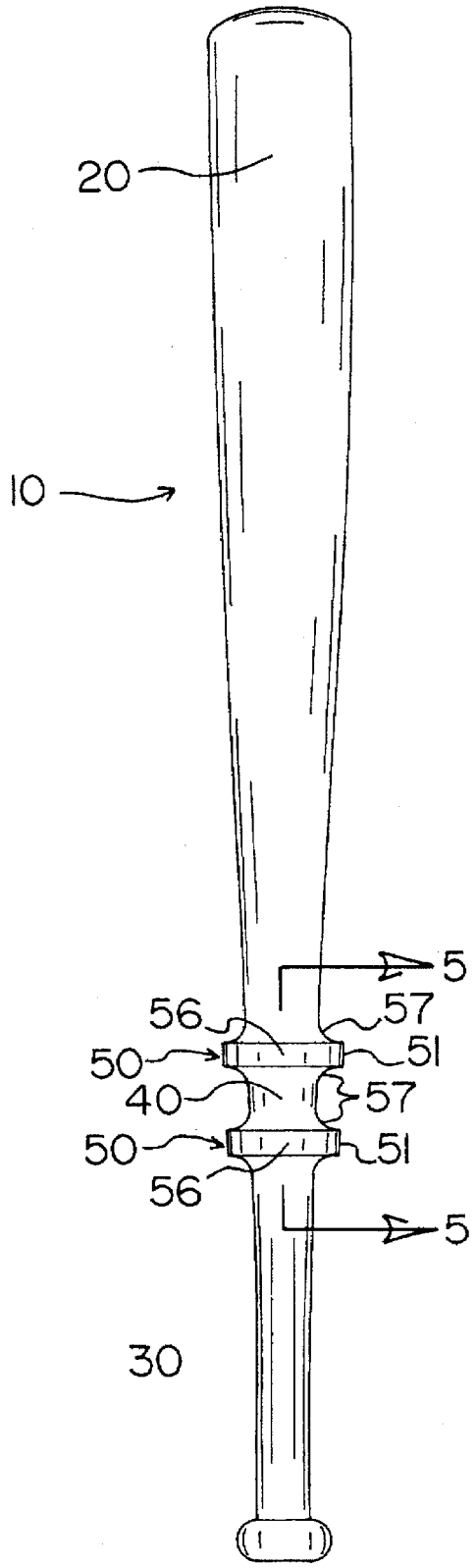
FIG. 2 is an illustration of a second embodiment of a new Shock and Vibration Absorbing Ball Bat according to the present invention.
Figure 3:
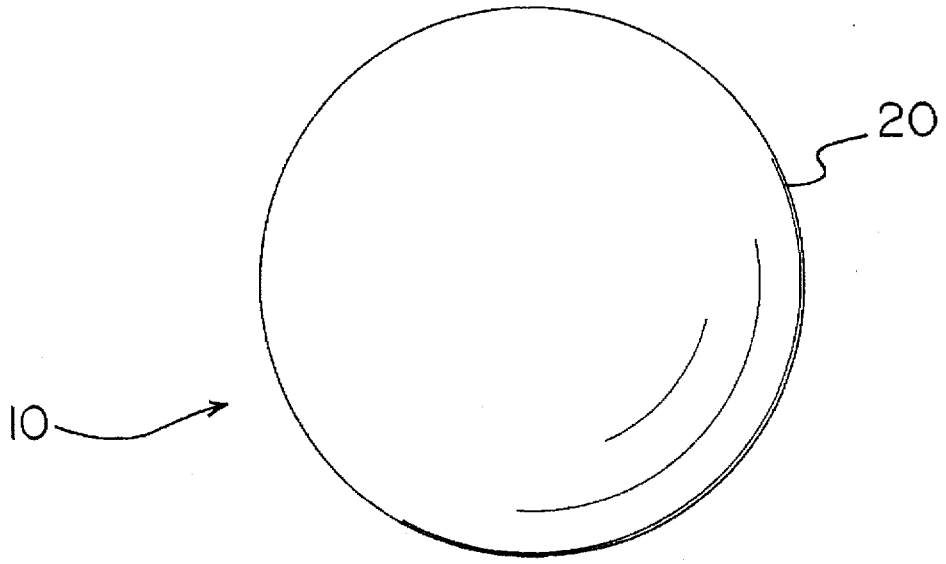
FIG. 3 is a top view of the present invention.
Figure 5:
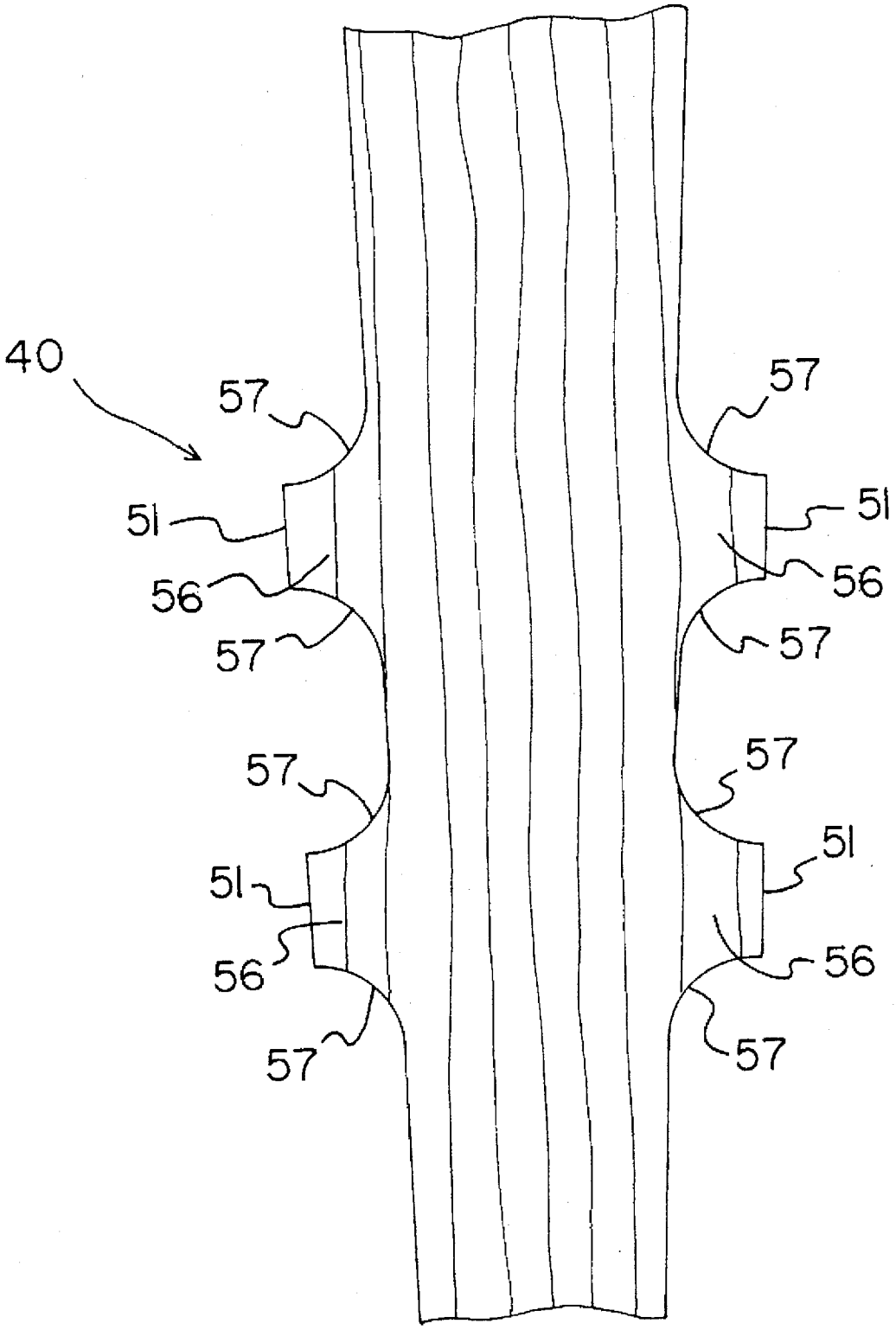
FIG. 5 is a cross sectional view taken along line 5—5 of FIG. 2.

As best illustrated in FIGS. 2 and 5, it can be shown that in a second embodiment of the present invention the knurl 50 is a cylindrical knurl 56 wherein the peripheral wall 51 of the cylindrical knurl 56 is cylindrical-shaped. A concave, arcuate section 57 is provided between the cylindrical-shaped peripheral wall 51 of the cylindrical knurl 56 and the intermediate portion 40 of the bat 10 immediately adjacent the cylindrical knurl 56. In the second embodiment, two cylindrical knurls 56 are provided in spaced relation along the intermediate portion 40 of the bat 10.

In use, a batter grasps the handle portion 30 of the bat 10 with his or her hands. The batter swings the bat 10 attempting to hit a thrown ball with the hitting portion 20 of the bat 10. If the batter is successful in hitting the thrown ball, the impact of the hitting portion 20 of the bat 10 against the ball will generate shock and vibration forces. These forces will travel down the bat 10 toward the intermediate portion 40 of the bat 10 and the knurls 50 provided along the intermediate portion 40. The knurls 50 will absorb the shock and vibration forces before they reach the handle portion 30 of the bat 10 and, in turn, the hands of the batter which are grasping the handle portion 30.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A Shock and Vibration Absorbing Ball Bat, comprising:

an elongated member formed of a single piece of material including a hitting portion, a handle portion, an intermediate portion provided between said hitting portion and said handle portion, and a knurl provided along said intermediate portion of said elongated member above said handle portion and below said hitting portion, said knurl coaxially aligned with said intermediate portion of said elongated member, said knurl being defined by a peripheral wall, said peripheral wall having a diameter greater than the diameter of said intermediate portion of said elongated member immediately adjacent said knurl whereby said knurl is radially enlarged relative to said intermediate portion of said elongated member immediately adjacent said knurl, wherein said knurl is a convex knurl and wherein said peripheral wall is convex-shaped.

2. The Shock and Vibration Absorbing Ball Bat of claim 1, wherein three of said convex knurls are provided in spaced relation along said intermediate portion of said bat.

3. A Shock and Vibration Absorbing Ball Bat, comprising:

an elongated member formed of a single piece of material including a hitting portion, a handle portion, an intermediate portion provided between said hitting portion and said handle portion, and a plurality of spaced radial knobs provided along said intermediate portion of said elongated member above said handle portion and below said hitting portion, each of said plurality of spaced radial knobs concentrically aligned with said intermediate portion of said elongated member, each of said plurality of spaced radial knobs projecting radially outward from said intermediate portion, whereby each of said plurality of spaced radial knobs have an outer diameter greater than that of said intermediate portion of said elongated member immediately adjacent each of said plurality of spaced radial knobs, wherein each of said plurality of spaced radial knobs are peripherally defined by a semi-circular edge, said semi-circular edge perpendicularly intersecting said intermediate portion of said elongated member.

4. The Shock and Vibration Absorbing Ball Bat of claim 3, wherein said plurality of spaced radial knobs comprises three radial knobs provided in spaced relation along said intermediate portion of said elongated member.

5. A Shock and Vibration Absorbing Ball Bat, comprising:

an elongated member formed of a single piece of material including a hitting portion, a handle portion, an intermediate portion provided between said hitting portion and said handle portion, and a plurality of spaced radial knobs provided along said intermediate portion of said elongated member above said handle portion and below said hitting portion, each of said plurality of spaced radial knobs concentrically aligned with said intermediate portion of said elongated member, each of said plurality of spaced radial knobs projecting radially outward from said intermediate portion, whereby each of said plurality of spaced radial knobs have an outer diameter greater than that of said intermediate portion of said elongated member immediately adjacent each of said plurality of spaced radial knobs, wherein each of said plurality of spaced radial knobs are peripherally defined by an arcuate upper edge, an arcuate lower edge substantially mirroring said arcuate upper edge, and a cylindrical outer edge interconnecting said arcuate upper edge and said arcuate lower edge, said arcuate upper edge and said arcuate lower edge each having a first end tangentially melding with said intermediate portion of said elongated member and a second end perpendicularly intersecting said cylindrical outer edge.

6. The Shock and Vibration Absorbing Ball Bat of claim 1, wherein said plurality of spaced radial knobs comprises two radial knobs provided in spaced relation along said intermediate portion of said elongated member.

* * * * *